US007812789B2

(12) United States Patent
Park et al.

(10) Patent No.: US 7,812,789 B2
(45) Date of Patent: Oct. 12, 2010

(54) PLASMA DISPLAY APPARATUS AND METHOD OF DRIVING THE SAME

(75) Inventors: Kirack Park, Gyeongsangbuk-do (KR); Seonghwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 994 days.

(21) Appl. No.: 11/603,139

(22) Filed: Nov. 22, 2006

(65) Prior Publication Data

US 2007/0115217 A1 May 24, 2007

(30) Foreign Application Priority Data

Nov. 23, 2005 (KR) ..... 10-2005-0112608

(51) Int. Cl.
*G09G 3/28* (2006.01)
*G09G 5/00* (2006.01)

(52) U.S. Cl. ..... 345/60; 345/208

(58) Field of Classification Search ..... 345/60, 345/208

See application file for complete search history.

(56) References Cited

U.S. PATENT DOCUMENTS 6,072,448 A * 6/2000 Kojima et al. ..... 345/63
6,538,392 B2 * 3/2003 Kanazawa ..... 315/169.4
2002/0195970 A1 * 12/2002 Lim et al. ..... 315/169.4
2003/0218582 A1 11/2003 Park et al. ..... 345/60
2003/0234753 A1 * 12/2003 Tanaka ..... 345/67

FOREIGN PATENT DOCUMENTS

EP 1 316 938 A2 6/2003
EP 1 406 238 A2 4/2004
KR 10-0195635 B1 2/1999
KR 10-1999-0042559 A 6/1999

OTHER PUBLICATIONS

European Search Report dated Feb. 8, 2007.
Korean Decision to Grant a Patent dated Jun. 21, 2007.

* cited by examiner

*Primary Examiner*—Amr Awad
*Assistant Examiner*—Jonathan Boyd
(74) *Attorney, Agent, or Firm*—Ked & Associates LLP

(57) ABSTRACT

A method of driving a plasma display apparatus is disclosed. The method includes supplying a data signal to a discharge cell during a-th to b-th subfields, arranged in increasing order of gray level weight, of an n-th frame, and supplying a data signal to the discharge cell during a (b+1)-th subfield of an (n+1)-th frame. The number of sustain signals assigned in the a-th to b-th subfields of the n-th frame is less than the number of sustain signals assigned in the (b+1)-th subfield of the (n+1)-th frame. The number of sustain signals assigned in a (b+1)-th subfield of the n-th frame is less than the number of sustain signals assigned in the (b+1)-th subfield of the (n+1)-th frame.

2 Claims, 12 Drawing Sheets

PLASMA DISPLAY APPARATUS AND METHOD OF DRIVING THE SAME

This Nonprovisional application claims priority under 35 U.S.C. §119(a) on Patent Application No. 10-2005-0112608 filed in Korea on Nov. 23, 2005 the entire contents of which are hereby incorporated by reference.

BACKGROUND

1. Field

This document relates to a method of driving a plasma display apparatus.

2. Description of the Related Art

A plasma display panel has the structure in which barrier ribs formed between a front panel and a rear panel forms unit discharge cell or discharge cells. Each discharge cell is filled with an inert gas containing a main discharge gas such as neon (Ne), helium (He) and a mixture of Ne and He, and a small amount of xenon (Xe). The plurality of discharge cells form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

The plasma display panel includes scan electrode lines, sustain electrode lines, address electrode lines. The plasma display panel represents a gray level during a frame including a plurality of subfields having a different number of discharges times. Each subfield is divided into a reset period for initializing wall charges of all discharge cells, an address period for selecting discharge cells from which light is emitted, and a sustain period for emitting light in the selected discharge cells.

During the address period, scan signals are sequentially supplied to the scan electrodes, and data signals synchronized with the scan signals are supplied to the address electrodes. In this case, an address discharge occurs in the discharge cells supplied with the high level data signal, and light is emitted from the discharge cells, where the address discharge occurs, during the sustain period.

Since sustain signals are supplied to the scan electrodes and the sustain electrodes during the sustain period, a sustain discharge occurs in the discharge cells where the address discharge occurs such that light is emitted.

SUMMARY OF THE INVENTION

In one aspect, a method of driving a plasma display apparatus comprising supplying a data signal to a discharge cell during a-th to b-th subfields, arranged in increasing order of gray level weight, of an n-th frame, and supplying a data signal to the discharge cell during a (b+1)-th subfield of an (n+1)-th frame, wherein the number of sustain signals assigned in the a-th to b-th subfields of the n-th frame is less than the number of sustain signals assigned in the (b+1)-th subfield of the (n+1)-th frame, and the number of sustain signals assigned in a (b+1)-th subfield of the n-th frame is less than the number of sustain signals assigned in the (b+1)-th subfield of the (n+1)-th frame.

In still another aspect, a method of driving a plasma display apparatus comprising supplying a data signal to a discharge cell during a-th to b-th subfields, arranged in increasing order of gray level weight, of an n-th frame, and supplying a data signal to the discharge cell during a (b+1)-th subfield of an (n+1)-th frame, wherein the number of sustain signals assigned in the a-th to b-th subfields of the n-th frame is less than the number of sustain signals assigned in the (b+1)-th subfield of the (n+1)-th frame, and the strength of a reset discharge generated by a reset signal supplied during a (b+1)-th subfield of the n-th frame is less than the strength of a reset discharge generated by a reset signal supplied during the (b+1)-th subfield of the (n+1)-th frame.

In yet still another aspect, a plasma display apparatus comprises a plasma display panel including a scan electrode, an address electrode, and a sustain electrode, a data driver that supplies a data signal to the address electrode during a-th to b-th subfields, arranged in increasing order of gray level weight, of an n-th frame, and supplies a data signal to the address electrode during a (b+1)-th subfield of an (n+1)-th frame, and a scan driver and a sustain driver that supply sustain signals, that is more than the number of sustain signals assigned in a (b+1)-th subfield of the n-th frame, to the scan electrode and the sustain electrode during the (b+1)-th subfield of the (n+1)-th frame, respectively, wherein the number of sustain signals assigned in the a-th to b-th subfields of the n-th frame is less than the number of sustain signals assigned in the (b+1)-th subfield of the (n+1)-th frame.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENTS

Figure 1:
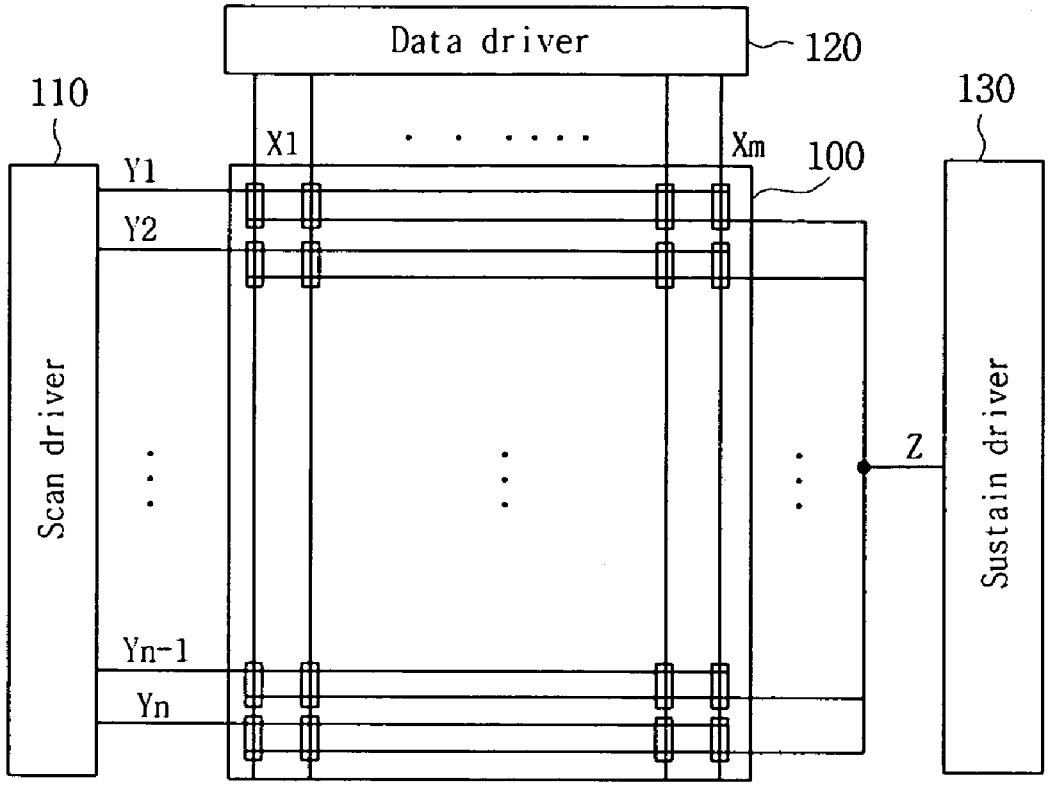
FIG. 1 illustrates a plasma display apparatus according to embodiments.

Preferred embodiments of the present invention will be described in a more detailed manner with reference to the drawings.

A method of driving a plasma display apparatus comprising supplying a data signal to a discharge cell during a-th to b-th subfields, arranged in increasing order of gray level weight, of an n-th frame, and supplying a data signal to the discharge cell during a (b+1)-th subfield of an (n+1)-th frame, wherein the number of sustain signals assigned in the a-th to b-th subfields of the n-th frame is less than the number of sustain signals assigned in the (b+1)-th subfield of the (n+1)-th frame, and the number of sustain signals assigned in a (b+1)-th subfield of the n-th frame is less than the number of sustain signals assigned in the (b+1)-th subfield of the (n+1)-th frame.

The highest voltage of the sustain signal supplied during the (b+1)-th subfield of the (n+1)-th frame may be more than the highest voltage of the sustain signal supplied during the (b+1)-th subfield of the n-th frame.

The highest voltages of some of all the sustain signals supplied during the (b+1)-th subfield of the (n+1)-th frame may be more than the highest voltages of the sustain signals supplied during the (b+1)-th subfield of the n-th frame.

The width of the sustain signal supplied during the (b+1)-th subfield of the (n+1)-th frame may be mote than the width of the sustain signal supplied during the (b+1)-th subfield of the n-th frame.

The widths of some of all the sustain signals supplied during the (b+1)-th subfield of the (n+1)-th frame may be more than the widths of the sustain signals supplied during the (b+1)-th subfield of the n-th frame.

The number of reset signals supplied during the (b+1)-th subfield of the (n+1)-th frame may be more than the number of reset signals supplied during the (b+1)-th subfield of the n-th frame.

The highest voltage of a reset signal supplied during the (b+1)-th subfield of the (n+1)-th frame may be more than the highest voltage of a reset signal supplied during the (b+1)-th subfield of the n-th frame.

A rising slope of a reset signal supplied during the (b+1)-th subfield of the (n+1)-th frame may be more than a rising slope of a reset signal supplied during the (b+1)-th subfield of the n-th frame.

A method of driving a plasma display apparatus comprising supplying a data signal to a discharge cell during a-th to b-th subfields, arranged in increasing order of gray level weight, of an n-th frame, and supplying a data signal to the discharge cell during a (b+1)-th subfield of an (n+1)-th frame, wherein the number of sustain signals assigned in the a-th to b-th subfields of the n-th frame is less than the number of sustain signals assigned in the (b+1)-th subfield of the (n+1)-th frame, and the strength of a reset discharge generated by a reset signal supplied during a (b+1)-th subfield of the n-th frame is less than the strength of a reset discharge generated by a reset signal supplied during the (b+1)-th subfield of the (n+1)-th frame.

The number of reset signals supplied during the (b+1)-th subfield of the n-th frame may be less than the number of reset signals supplied during the (b+1)-th subfield of the (n+1)-th frame.

The highest voltage of the reset signal supplied during the (b+1)-th subfield of the n-th frame may be less than the highest voltage of the reset signal supplied during the (b+1)-th subfield of the (n+1)-th frame.

A rising slope of the reset signal supplied during the (b+1)-th subfield of the n-th frame may be less than a rising slope of the reset signal supplied during the (b+1)-th subfield of the (n+1)-th frame.

A plasma display apparatus comprises a plasma display panel including a scan electrode, an address electrode, and a sustain electrode, a data driver that supplies a data signal to the address electrode during a-th to b-th subfields, arranged in increasing order of gray level weight, of an n-th frame, and supplies a data signal to the address electrode during a (b+1)-th subfield of an (n+1)-th frame, and a scan driver and a sustain driver that supply sustain signals, that is more than the number of sustain signals assigned in a (b+1)-th subfield of the n-th frame, to the scan electrode and the sustain electrode during the (b+1)-th subfield of the (n+1)-th frame, respectively, wherein the number of sustain signals assigned in the a-th to b-th subfields of the n-th frame is less than the number of sustain signals assigned in the (b+1)-th subfield of the (n+1)-th frame.

The highest voltage of the sustain signal supplied during the (b+1)-th subfield of the (n+1)-th frame may be more than the highest voltage of the sustain signal supplied during the (b+1)-th subfield of the n-th frame.

The width of the sustain signal supplied during the (b+1)-th subfield of the (n+1)-th frame may be more than the width of the sustain signal supplied during the (b+1)-th subfield of the n-th frame.

The number of reset signals supplied during the (b+1)-th subfield of the (n+1)-th frame may be more than the number of reset signals supplied during the (b+1)-th subfield of the n-th frame.

The highest voltage of a reset signal supplied during the (b+1)-th subfield of the (n+1)-th frame may be more than the highest voltage of a reset signal supplied during the (b+1)-th subfield of the n-th frame.

Hereinafter, exemplary embodiments of the present invention will be described in detail with reference to the attached drawings.

FIG. 1 illustrates a plasma display apparatus according to embodiments. As illustrated in FIG. 1, the plasma display apparatus according to the embodiments includes a plasma display panel 100, a scan driver 110, a data driver 120, and a sustain driver 130.

The plasma display panel 100 includes scan electrodes Y1 to Yn, address electrodes X1 to Xm, and sustain electrodes Z. The structure of the plasma display panel will be described in detail with reference to FIG. 2.

Figure 2:
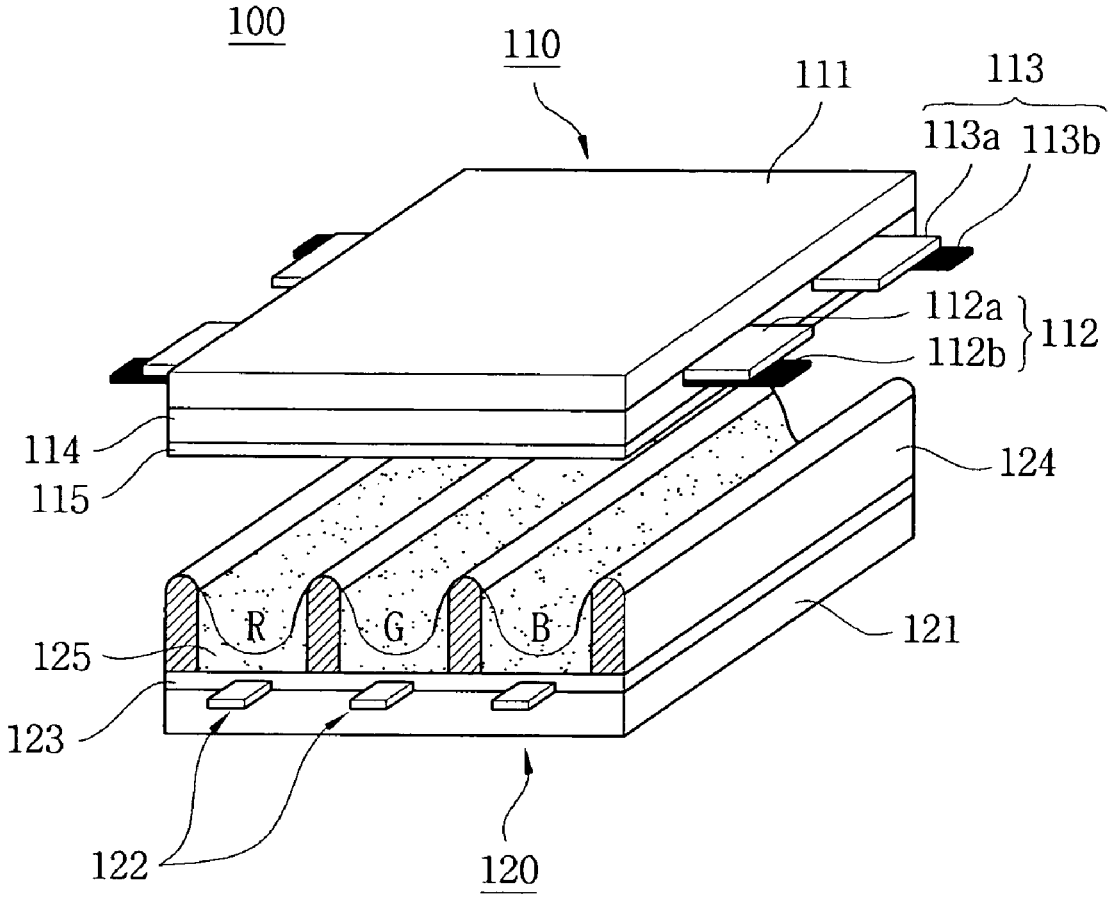
FIG. 2 illustrates a plasma display panel of the plasma display apparatus according to the embodiments.

FIG. 2 illustrates a plasma display panel of the plasma display apparatus according to the embodiments.

The plasma display panel 100 includes a front panel 110 and a rear panel 120. The front panel 110 includes a front substrate 111, and a scan electrode 112 and a sustain electrode 113 formed on the front substrate 111. Further, the front panel 110 includes an upper dielectric layer 114 covering the scan electrode 112 and the sustain electrode 113, and a protective layer 115 covering the upper dielectric layer 114.

The scan electrode 112 and the sustain electrode 113 each include transparent electrodes 112*a* and 113*a*, and bus electrodes 112*b* and 113*b*. The transparent electrodes 112*a* and 113*a* are made of a transparent indium-tin-oxide (ITO) material, and diffuse a discharge into the entire area of discharge cells. The bus electrodes 112*b* and 113*b* are made of a metal material having a resistance, that is smaller than a resistance of the transparent electrodes 112*a* and 113*a*.

The upper dielectric layer 114 provides insulation between the scan electrode 112 and the sustain electrode 113. The protective layer 115 protects the scan electrode 112 and the sustain electrode 113. Secondary electrons are emitted from the protective layer 115.

The rear panel 120 includes a rear substrate 121, an address electrode 122, a lower dielectric layer 123, a barrier rib 124, and a phosphor layer 125.

The address electrode 122 is formed on the rear substrate 121 and intersects the scan electrode 112 and the sustain electrode 113. An intersection area of the address electrode 122 and the scan and sustain electrodes 112 and 113 is an area of a discharge cell. The lower dielectric layer 123 covers the address electrode 122, and provides insulation between the address electrodes 122. The barrier rib 124 is formed on the lower dielectric layer 123, and partitions a discharge cell. The phosphor layer 125 is positioned between the barrier ribs 124. Visible light is emitted from the phosphor layer 125 when generating a sustain discharge.

In FIG. 2, the scan electrode 112 and the sustain electrode 113 each include the transparent electrodes 112*a* and 113*a* and the bus electrodes 112*b* and 113*b*. However, the scan electrode 112 and the sustain electrode 113 each may include only the bus electrode.

An operation of each of the scan driver 110, the data driver 120, and the sustain driver 130 of FIG. 1 will be described in detail with reference to FIG. 3.

Figure 3:
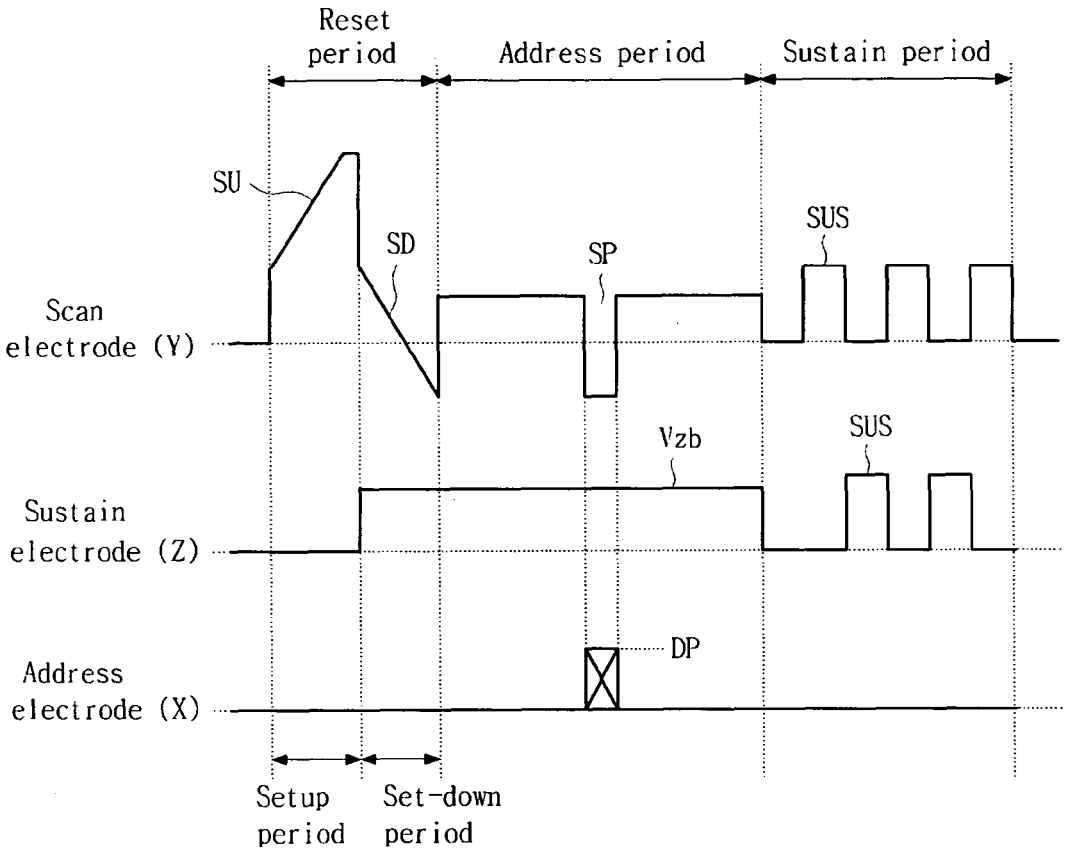
FIG. 3 illustrates a waveform of a driving signal for driving the plasma display apparatus according to the embodiments.

FIG. 3 illustrates a waveform of a driving signal for driving the plasma display apparatus according to the embodiments. The scan driver 110 of FIG. 1 supplies a setup signal (SU) with a gradually rising voltage to the scan electrode Y during a setup period of a reset period. This results in the accumulation of a proper amount of wall charges on the discharge cells of the plasma display panel. The scan driver 110 supplies a set-down signal (SD) with a gradually falling voltage to the scan electrode Y during a set-down period of the reset period. This results in the erasure of a predetermined amount of wall charges accumulated on the discharge cells. Accordingly, the wall charges remaining in the discharge cells are uniform to the extent that an address discharge can be stably performed.

During the address period, the scan driver 110 supplies a scan signal (SP) to the scan electrode Y, and the data driver 120 supplies a data signal (DP) synchronized with the scan signal (SP) to the address electrode X. The data signal (DP) corresponds to a video signal obtained after performing an inverse gamma correction process, a half-toning process, a subfield-mapping process, and a subfield arrangement process on an initial video signal input from the outside. Therefore, the discharge cells, from which light will be emitted during a sustain period, are selected the address period. The sustain driver 130 supplies a bias voltage Vzb to the sustain electrode Z during the set-down period and the address period. The bias voltage Vzb accelerates an opposite discharge between the scan electrode Y and the address electrode generated during the address period.

The scan driver 110 and the sustain driver 130 alternately supply sustain signals (SUS) to the scan electrode Y and the sustain electrode Z during the sustain period. As a wall voltage within the cells selected by performing the address discharge is added to the sustain signal (SUS), every time the sustain signal (SUS) is supplied, a sustain discharge occurs between the scan electrode Y and the sustain electrode Z.

Figure 4:
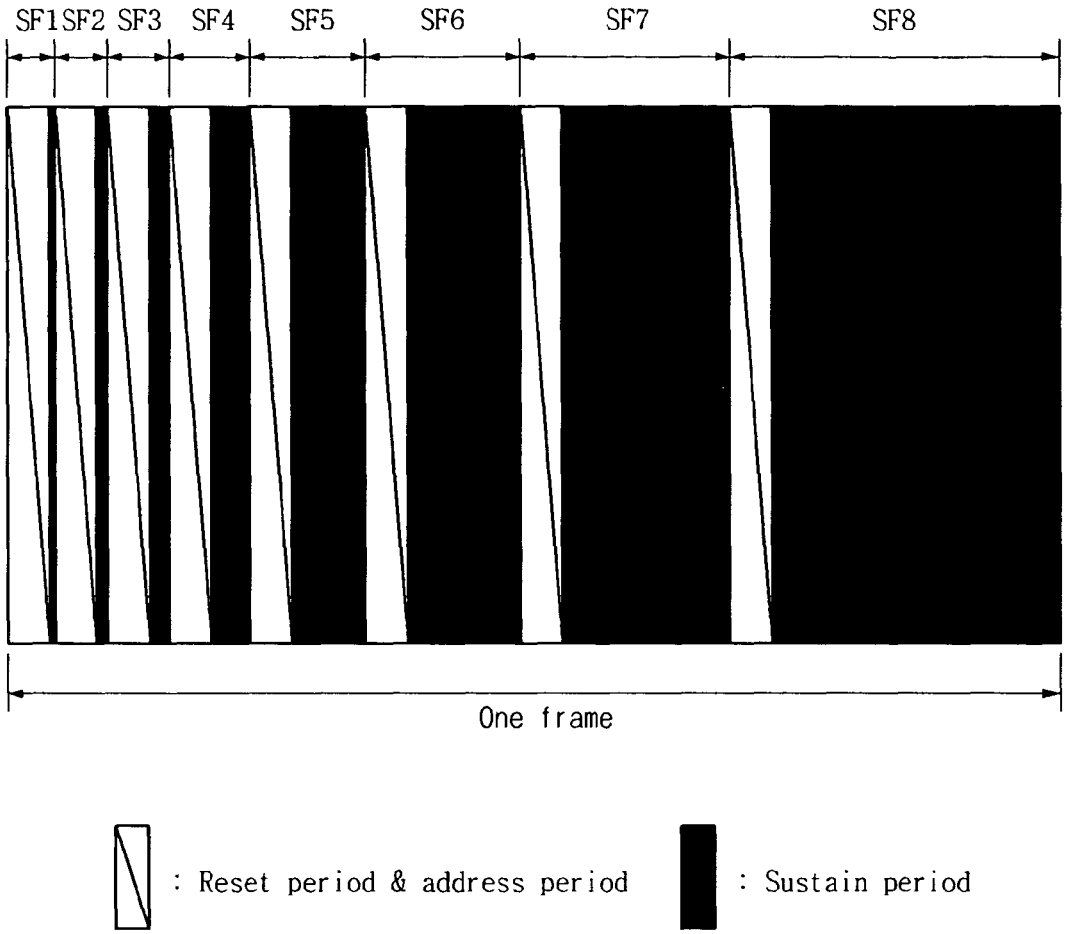
FIG. 4 illustrates a method for representing a gray level of the plasma display apparatus according to the embodiments.

FIG. 4 illustrates a method for representing a gray level of the plasma display apparatus according to the embodiments. As illustrated in FIG. 4, one frame includes a plurality of subfields SF1 to SF8, and each subfield includes a reset period, an address period, and a sustain period. The scan driver 110, the data driver 120, and the sustain driver 130 of FIG. 1 supply the driving signal of FIG. 3 in each subfield. A duration of the sustain period of each subfield is proportional to gray level weight of each subfield. To represent a specific gray level in the plasma display apparatus according to the embodiments, light is emitted during the sustain period of at least one subfield of all the subfields, and thus displaying an image.

The gray level weight of each subfield may increase in a ratio of $2^n$ (where, n=0, 1, 2, 3, 4, 5, 6, 7). In other words, the ratio of the gray level weight of each subfield satisfies the following equation: SF1: SF2: SF3: SF4: SF5: SF6: SF7: SF8=$2^0$: $2^1$: $2^2$: $2^3$: $2^4$: $2^5$: $2^6$: $2^7$. An increase ratio in the gray level weight of each subfield may not be $2^n$. In other words, the ratio of the gray level weight of each subfield may satisfy the following equation: SF1: SF2: SF3: SF4: SF5: SF6: SF7: SF8=1: 3: 5: 7: 9: 11: 13: 15. Further, in FIG. 4, the plurality of subfields are arranged in increasing order of the gray level weight. However, the plasma display apparatus according to the embodiments may be driven during the plurality of subfields that are not arranged in increasing order of the gray level weight. For example, a plurality of subfields of one frame may be arranged in order of SF1, SF3, SF2, SF4, SF6, SF7, SF5 and SF8.

In FIG. 4, one frame includes the 8 subfields. However, one frame may include 8 or more subfields.

The plasma display apparatus according to the embodiments controls the number of sustain signals to prevent gray level inversion.

Figure 5:
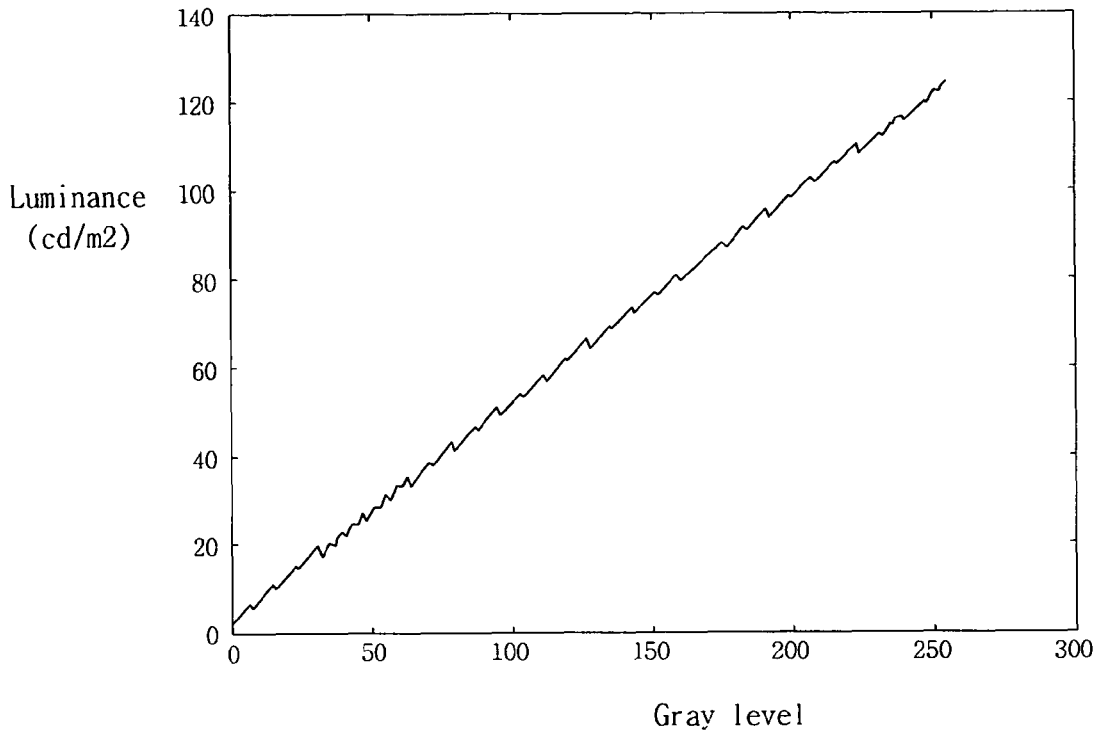
FIG. 5 is a graph for explaining gray level inversion.

FIG. 5 is a graph for explaining gray level inversion. As above, the plasma display apparatus is driven by generating a reset discharge, an address discharge, and a sustain discharge during the reset period, the address period, and the sustain period, respectively. Light is emitted by the reset discharge and the address discharge as well as the sustain discharge. Therefore, gray level inversion, where quantity of light of the plasma display apparatus for representing a gray level of k is more than quantity of light of the plasma display apparatus for representing a gray level of k+1, occurs.

To prevent the gray level inversion, the data driver 120 supplies a data signal to the discharge cell during a-th to b-th subfields of an n-th frame. The scan driver 110 and the sustain driver 130 supply a sustain signal to the discharge cell during the a-th to b-th subfields of the n-th frame. The a-th to b-th subfields of the n-th frame are arranged in increasing order of gray level weight. The data driver 120 supplies a data signal to the discharge cell during a (b+1)-th subfield of an (n+1)-th frame, and the scan driver 110 and the sustain driver 130 supply a sustain signal to the discharge cell during a sustain period of the (b+1)-th subfield of the (n+1)-th frame.

In this case, the number of sustain signals assigned in the a-th to b-th subfields of the n-th frame is less than the number of sustain signals assigned in the (b+1)-th subfield of the (n+1)-th frame. The number of sustain signals assigned in a (b+1)-th subfield of the n-th frame is less than the number of sustain signals assigned in the (b+1)-th subfield of the (n+1)-th frame. The sustain signal is supplied in accordance with the number of sustain signals assigned in each subfield.

The following is a detailed description of an operation of the plasma display apparatus according to the embodiments, with reference to the attached drawings.

Figure 6:
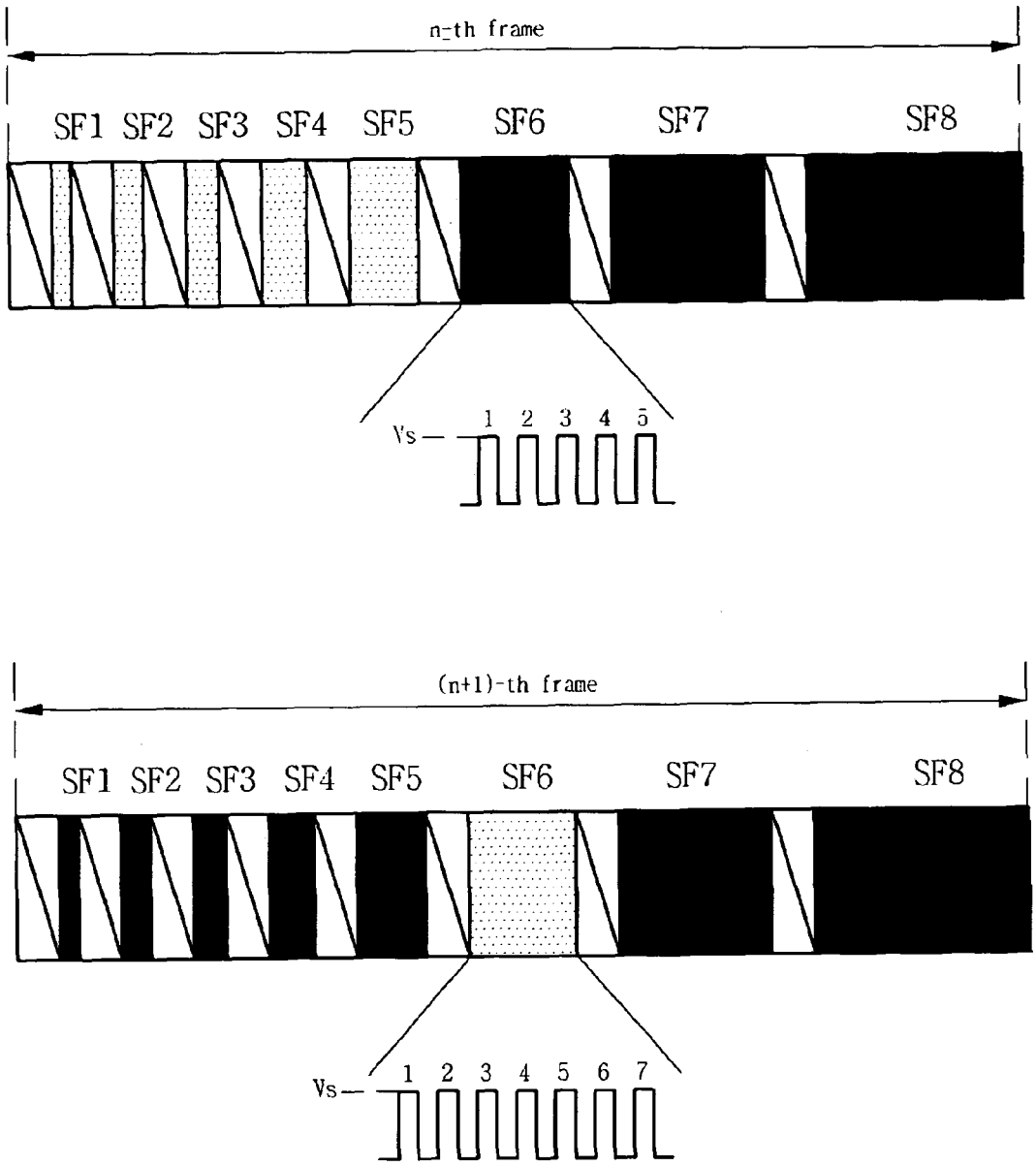
FIG. 6 illustrates a method of driving a plasma display apparatus according to a first embodiment.

FIG. 6 illustrates a method of driving a plasma display apparatus according to a first embodiment.

As illustrated in FIG. 6, an n-th frame and an (n+1)-th frame each include 8 subfields SF1 to SF8. The 8 subfields SF1 to SF8 are arranged in increasing order of gray level weight. In other words, the subfield SF1 has the smallest gray level weight, and the subfield SF8 has the largest gray level weight. Therefore, the number of sustain signals assigned during a sustain period of the subfield SF1 is the smallest, and the number of sustain signals assigned during a sustain period of the subfield SF8 is the largest.

The plasma display apparatus according to the embodiments may be driven in accordance with a plurality of subfields that are arranged in increasing order of gray level weight. The plasma display apparatus according to the embodiments may be driven in accordance with a plurality of subfields that are not arranged in increasing order of gray level weight.

The data driver 120 supplies a data signal to the discharge cell during address periods of the subfields SF1 to SF5 of the n-th frame. The scan driver 110 and the sustain driver 130 supply a sustain signal to the discharge cell during sustain periods of the subfields SF1 to SF5 of the n-th frame in accordance to gray level weight of each of the subfields SF1 to SF5.

The data driver 120 supplies a data signal to the discharge cell during an address period of the subfield SF6 of the (n+1)-th frame. The scan driver 110 and the sustain driver 130 supply a sustain signal to the discharge cell during a sustain period of the subfield SF6 of the (n+1)-th frame.

In this case, the number of sustain signals assigned in the subfields SF1 to SF5 of the n-th frame is less than the number of sustain signals assigned in the subfield SF6 of the (n+1)-th frame. Further, the number of sustain signals assigned in the subfield SF6 of the n-th frame is less than the number of sustain signals assigned in the subfield SF6 of the (n+1)-th frame.

For example, it is assumed that gray level weights of the plurality of subfields SF1 to SF8 of each of the n-th and (n+1)-th frames increases in a ratio of $2^n$. When the data signal is supplied during only the address periods of the subfields SF1 to SF5 of the n-th frame, a sum of the gray level weights of the subfields SF1 to SF5 of the n-th frame is 31 ($=2^0+2^1+2^2+2^3+2^4$). When the data signal is supplied during only the address period of the subfield SF6 of the (n+1)-th frame, gray level weight of the subfield SF6 of the (n+1)-th frame is 32 ($=2^5$).

As above, a sum of the gray level weights of the subfields SF1 to SF5 of the n-th frame is smaller than the gray level weight of the subfield SF6 of the (n+1)-th frame. In other words, since gray level weight of each subfield is proportional to the number of sustain signals supplied during a sustain period of each subfield, the number of sustain signals supplied during the subfields SF1 to SF5 of the n-th frame is less than the number of sustain signals supplied during the subfield SF6 of the (n+1)-th frame.

The scan driver 120 and the sustain driver 130 supply 7 sustain signals, that is more than 5 sustain signals assigned in the subfield SF6 of the n-th frame, during the subfield SF6 of the (n+1)-th frame. Accordingly, since quantity of light corresponding to the gray level weight (=32) of the subfield SF6 of the (n+1)-th frame is more than quantity of light corresponding to a sum (=31) of the gray level weights of the subfields SF1 to SF5 of the n-th frame, the gray level inversion is prevented and gray level linearity is improved.

Figure 7A:
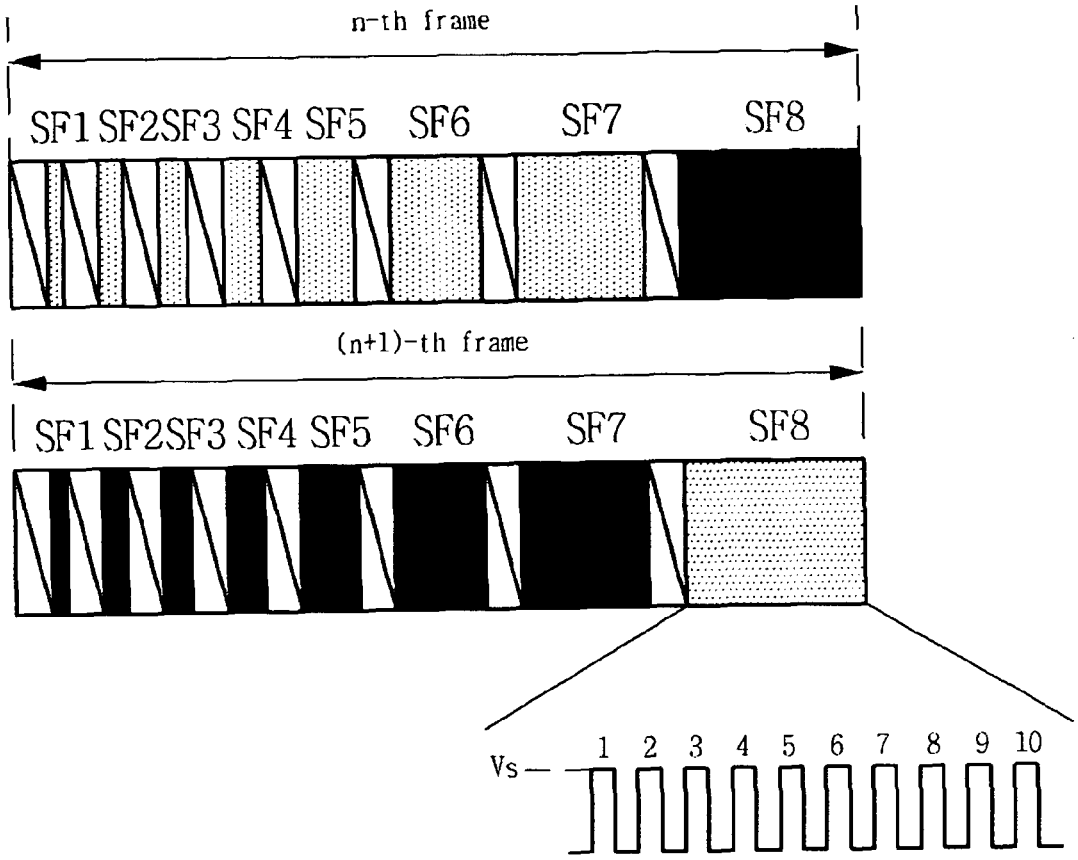
FIGS. 7*a* and 7*b* illustrate a method of driving a plasma display apparatus according to a second embodiment.
Figure 7B:
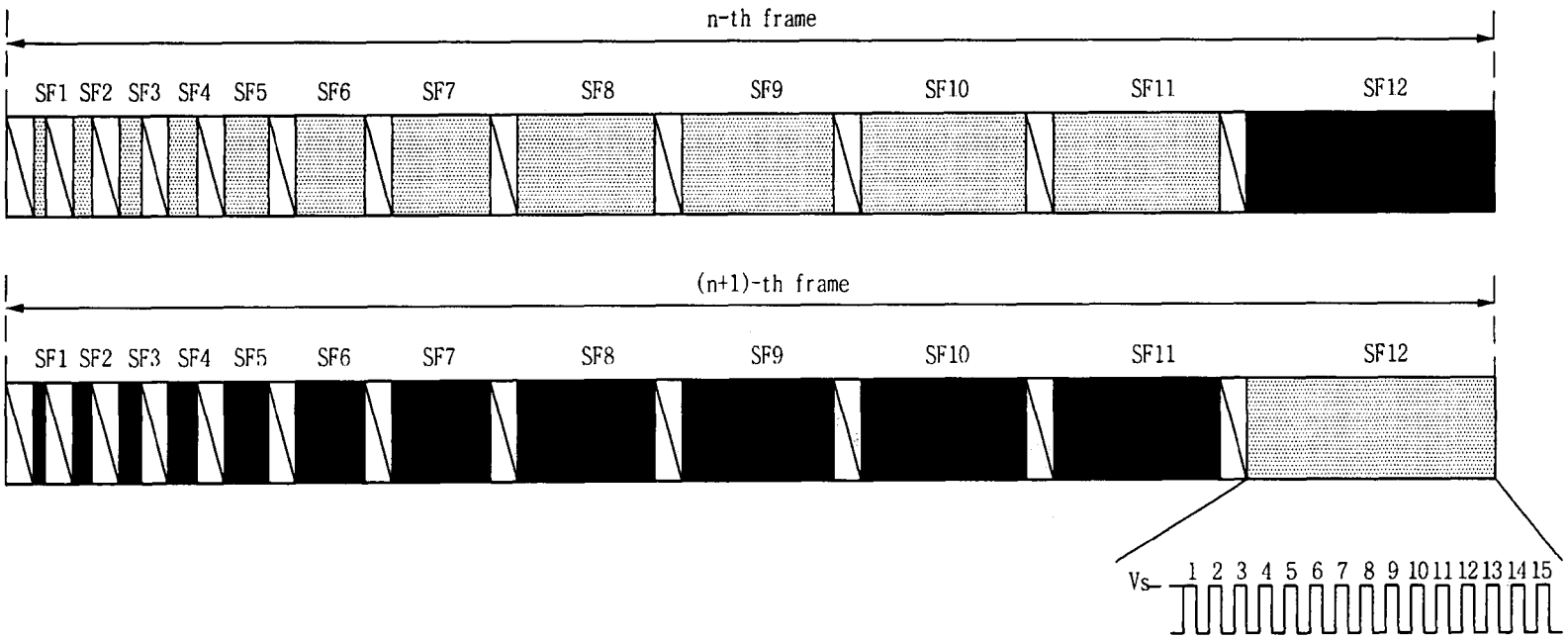

FIGS. 7*a* and 7*b* illustrate a method of driving a plasma display apparatus according to a second embodiment.

One frame illustrated in FIG. 7*a* includes 8 subfields SF1 to SF8, and one frame illustrated in FIG. 7*b* includes 12 subfields SF1 to SF12.

As illustrated in FIG. 7*a*, a data signal is supplied during address periods of subfields SF1 to SF7 of an n-th frame, and a data signal is not supplied during an address period of a subfield SF8 of the n-th frame. Further, a data signal is not supplied during address periods of subfields SF1 to SF7 of an (n+1)-th frame, and a data signal is supplied during an address period of a subfield SF8 of the (n+1)-th frame. To prevent gray level inversion, the number of sustain signals assigned in a sustain period of the subfield SF8 of the (n+1)-th frame is more than the number of sustain signals assigned in a sustain period of the subfield SF8 of the n-th frame.

As illustrated in FIG. 7*b*, a data signal is supplied during address periods of subfields SF1 to SF11 of an n-th frame, and a data signal is not supplied during an address period of a subfield SF12 of the n-th frame. Further, a data signal is not supplied during address periods of subfields SF1 to SF11 of an (n+1)-th frame, and a data signal is supplied during an address period of a subfield SF12 of the (n+1)-th frame. To prevent gray level inversion, the number of sustain signals assigned in a sustain period of the subfield SF12 of the (n+1)-th frame is more than the number of sustain signals assigned in a sustain period of the subfield SF12 of the n-th frame.

The number of sustain signals assigned in the sustain period of the subfield SF12 of the (n+1)-th frame in FIG. 7*b* is more than the number of sustain signals assigned in the sustain period of the subfield SF8 of the (n+1)-th frame in FIG. 7*a*.

In other words, as a difference between the number of subfields of one frame supplied with a data signal and the number of subfields of one frame during which a data signal is not supplied increases, the number of sustain signals assigned in the subfield having the largest gray level weight increases. For example, as illustrated in FIGS. 7*a* and 7*b*, a difference between the number of subfields of one frame supplied with the data signal and the number of subfields of one frame during which a data signal is not supplied is 6 and 10 in FIGS. 7*a* and 7*b*, respectively. Therefore, the number (=15) of sustain signals assigned in the subfield SF12 having the largest gray level weight in FIG. 7*b* is more than the number (=10) of sustain signals assigned in the subfield SF8 having the largest gray level weight in FIG. 7*a*.

Figure 8:
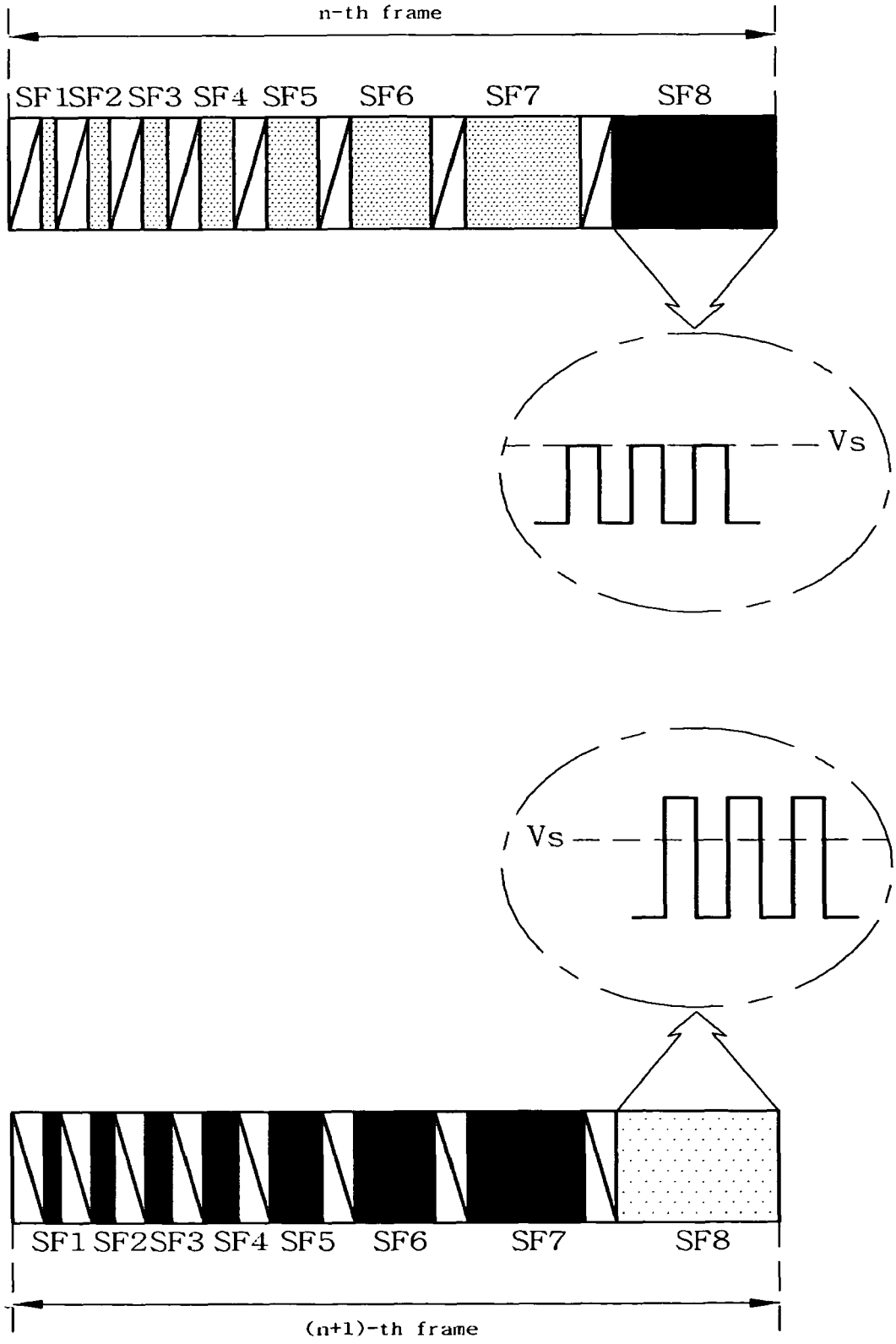
FIG. 8 illustrates a method of driving a plasma display apparatus according to a third embodiment.

FIG. 8 illustrates a method of driving a plasma display apparatus according to a third embodiment.

The data driver 120 of FIG. 1 supplies a data signal to the discharge cell during address periods of subfields SF1 to SF7 of an n-th frame. The scan driver 110 and the sustain driver 130 supply a sustain signal to the discharge cell during sustain periods of the subfields SF1 to SF7 of the n-th frame in accordance to a gray level weight of each of the subfields SF1 to SF7.

The data driver 120 supplies a data signal to the discharge cell during an address period of a subfield SF8 of an (n+1)-th frame. The scan driver 110 and the sustain driver 130 supply a sustain signal to the discharge cell during a sustain period of the subfield SF8 of the (n+1)-th frame.

In this case, the number of sustain signals assigned in the subfields SF1 to SF7 of the n-th frame is less than the number of sustain signals assigned in the subfield SF8 of the (n+1)-th frame. Further, the highest voltage of sustain signals assigned in the subfield SF8 of the n-th frame is less than the highest voltage of the sustain signals assigned in the subfield SF8 of the (n+1)-th frame.

The strength of the sustain discharge generated by the sustain signal is affected by the highest voltage of the sustain signal as well as the number of sustain signals. In other words, the highest voltage of the sustain signal is proportional to the strength of the sustain discharge. Accordingly, when the highest voltage (Vs) of the sustain signals assigned in the subfield SF8 of the n-th frame is less than the highest voltage of the sustain signals assigned in the subfield SF8 of the (n+1)-th frame, a strong sustain discharge occurs in the subfield SF8 of the (n+1)-th frame, thereby preventing gray level inversion.

In this case, the highest voltages of some of all the sustain signals supplied during the subfield SF8 of the (n+1)-th frame may be more than the highest voltages (Vs) of the sustain signals assigned in the subfield SF8 of the n-th frame. Further, the highest voltages of all the sustain signals supplied during the subfield SF8 of the (n+1)-th frame may be more than the highest voltages (Vs) of the sustain signals assigned in the subfield SF8 of the n-th frame.

The number of sustain signals as well as the highest voltage of the sustain signals may increase. More specifically, the number of sustain signals assigned in the subfields SF1 to SF7 of the n-th frame is less than the number of sustain signals assigned in the subfield SF8 of the (n+1)-th frame, the number of sustain signals assigned in the subfield SF8 of the n-th frame is less than the number of sustain signals assigned in the subfield SF8 of the (n+1)-th frame, and at the same time, the highest voltage (Vs) of the sustain signals assigned in the subfield SF8 of the n-th frame is less than the highest voltage of the sustain signals assigned in the subfield SF8 of the (n+1)-th frame.

Accordingly, the strong sustain discharge occurs in the subfield SF8 of the (n+1)-th frame, and thus preventing the gray level inversion.

Figure 9:
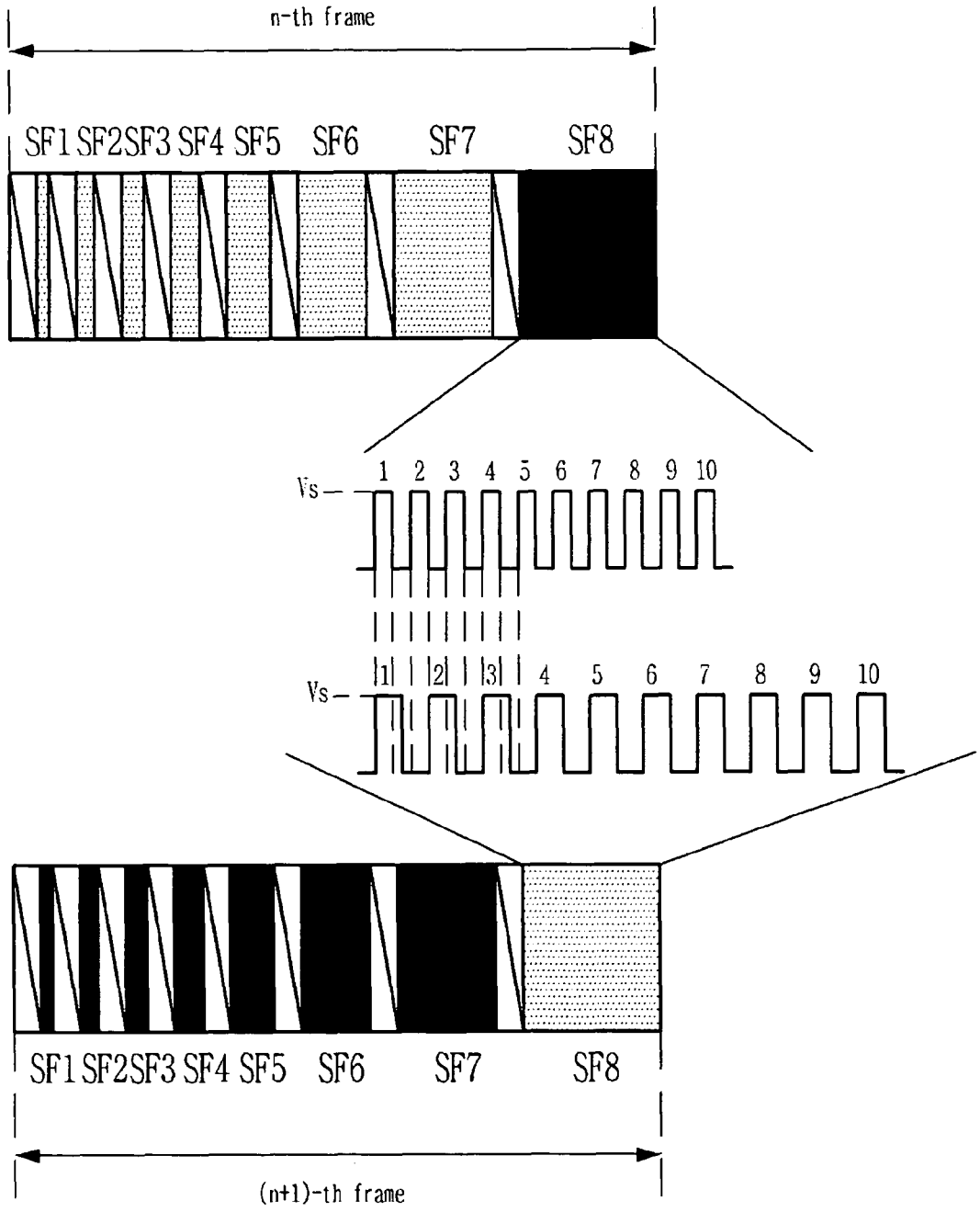
FIG. 9 illustrates a method of driving a plasma display apparatus according to a fourth embodiment.

FIG. 9 illustrates a method of driving a plasma display apparatus according to a fourth embodiment.

As illustrated in FIG. 9, the number of sustain signals assigned in subfields SF1 to SF7 of an n-th frame is less than the number of sustain signals assigned in a subfield SF8 of an (n+1)-th frame, and the width of sustain signals assigned in a subfield SF8 of the n-th frame is less than the width of the sustain signals assigned in the subfield SF8 of the (n+1)-th frame.

The strength of a sustain discharge generated by the sustain signals is affected by the width of the sustain signals as well as the number of sustain signals. In other words, the width of the sustain signal is proportional to the strength of the sustain discharge. Accordingly, when the width of the sustain signals assigned in the subfield SF8 of the n-th frame is less than the width of the sustain signals assigned in the subfield SF8 of the (n+1)-th frame, a strong sustain discharge occurs in the subfield SF8 of the (n+1)-th frame, thereby preventing gray level inversion.

In this case, the widths of some of all the sustain signals supplied during the subfield SF8 of the (n+1)-th frame may be more than the widths of the sustain signals assigned in the subfield SF8 of the n-th frame. Further, the width of all the sustain signals supplied during the subfield SF8 of the (n+1)-th frame may be more than the width of the sustain signals assigned in the subfield SF8 of the n-th frame.

The number of sustain signals as well as the width the sustain signals may increase. More specifically, the number of sustain signals assigned in the subfields SF1 to SF7 of the n-th frame is less than the number of sustain signals assigned in the subfield SF8 of the (n+1)-th frame, the number of sustain signals assigned in the subfield SF8 of the n-th frame is less than the number of sustain signals assigned in the subfield SF8 of the (n+1)-th frame, and at the same time, the width of the sustain signals assigned in the subfield SF8 of the n-th frame is less than the width of the sustain signals assigned in the subfield SF8 of the (n+1)-th frame.

Accordingly, the strong sustain discharge occurs in the subfield SF8 of the (n+1)-th frame, and thus preventing the gray level inversion.

Figure 10:
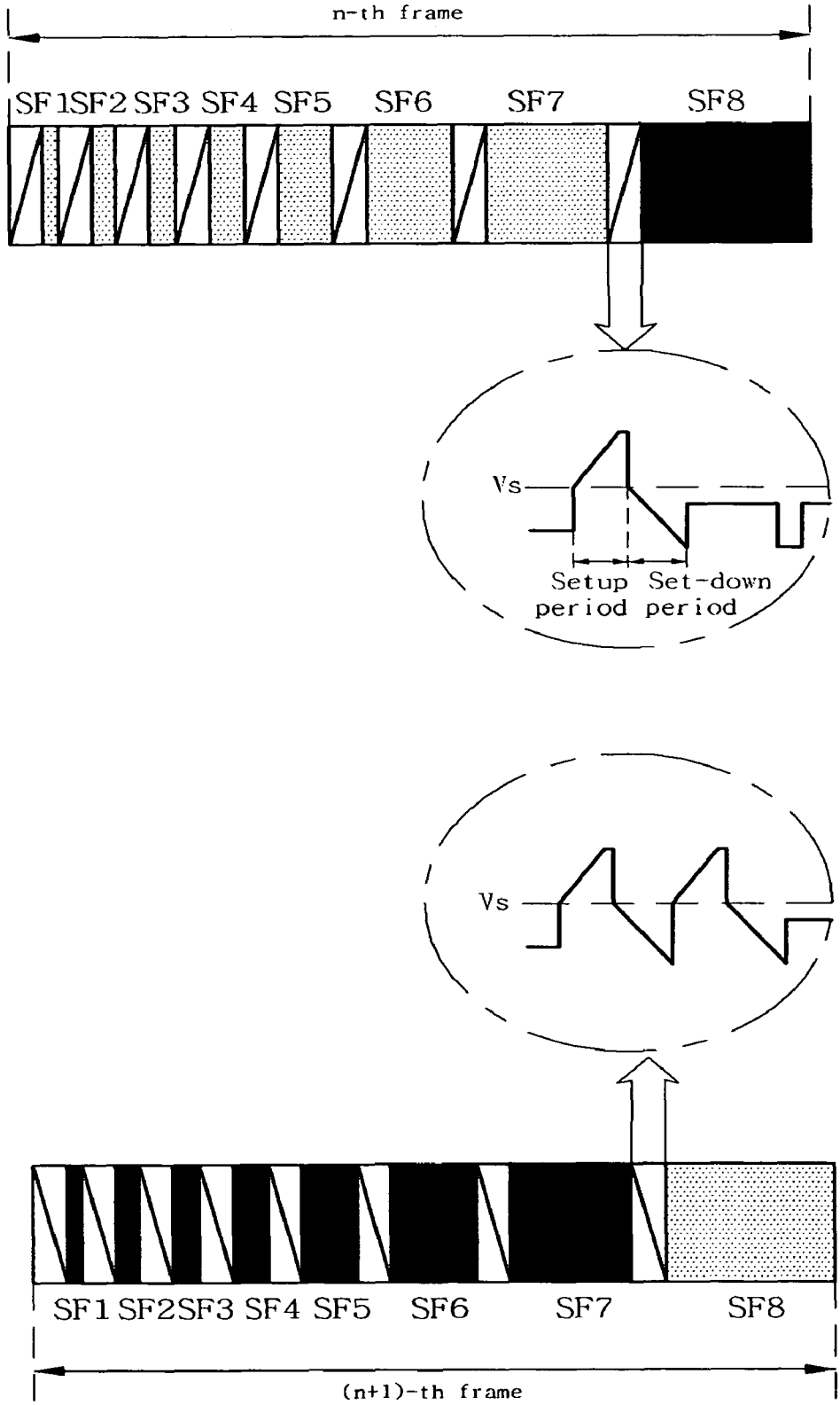
FIG. 10 illustrates a method of driving a plasma display apparatus according to a fifth embodiment.

FIG. 10 illustrates a method of driving a plasma display apparatus according to a fifth embodiment.

As illustrated in FIG. 10, the number of sustain signals assigned in subfields SF1 to SF7 of an n-th frame is less than the number of sustain signals assigned in a subfield SF8 of an (n+1)-th frame, and the number of reset signals supplied during a subfield SF8 of the n-th frame is less than the number of reset signals supplied during the subfield SF8 of the (n+1)-th frame.

To prevent gray level inversion, quantity of light emitted during the subfield SF8 of the (n+1)-th frame has to increase. When the number of reset signals supplied during the subfield SF8 of the (n+1)-th frame, as illustrated in FIG. 10, increases, the quantity of light emitted during the subfield SF8 of the (n+1)-th frame increases by an increase in the number of-reset discharge times. Thus, the gray level inversion is prevented.

The number of sustain signals as well as the number of reset signals may increase. More specifically, the number of sustain signals assigned in the subfields SF1 to SF7 of the n-th frame is less than the number of sustain signals assigned in the subfield SF8 of the (n+1)-th frame, the number of sustain signals assigned in the subfield SF8 of the n-th frame is less than the number of sustain signals assigned in the subfield SF8 of the (n+1)-th frame, and at the same time, the number of reset signals supplied during the subfield SF8 of the n-th frame is less than the number of reset signals supplied during the subfield SF8 of the (n+1)-th frame.

Accordingly, a strong sustain discharge occurs in the subfield SF8 of the (n+1)-th frame, and thus preventing the gray level inversion.

Figure 11:
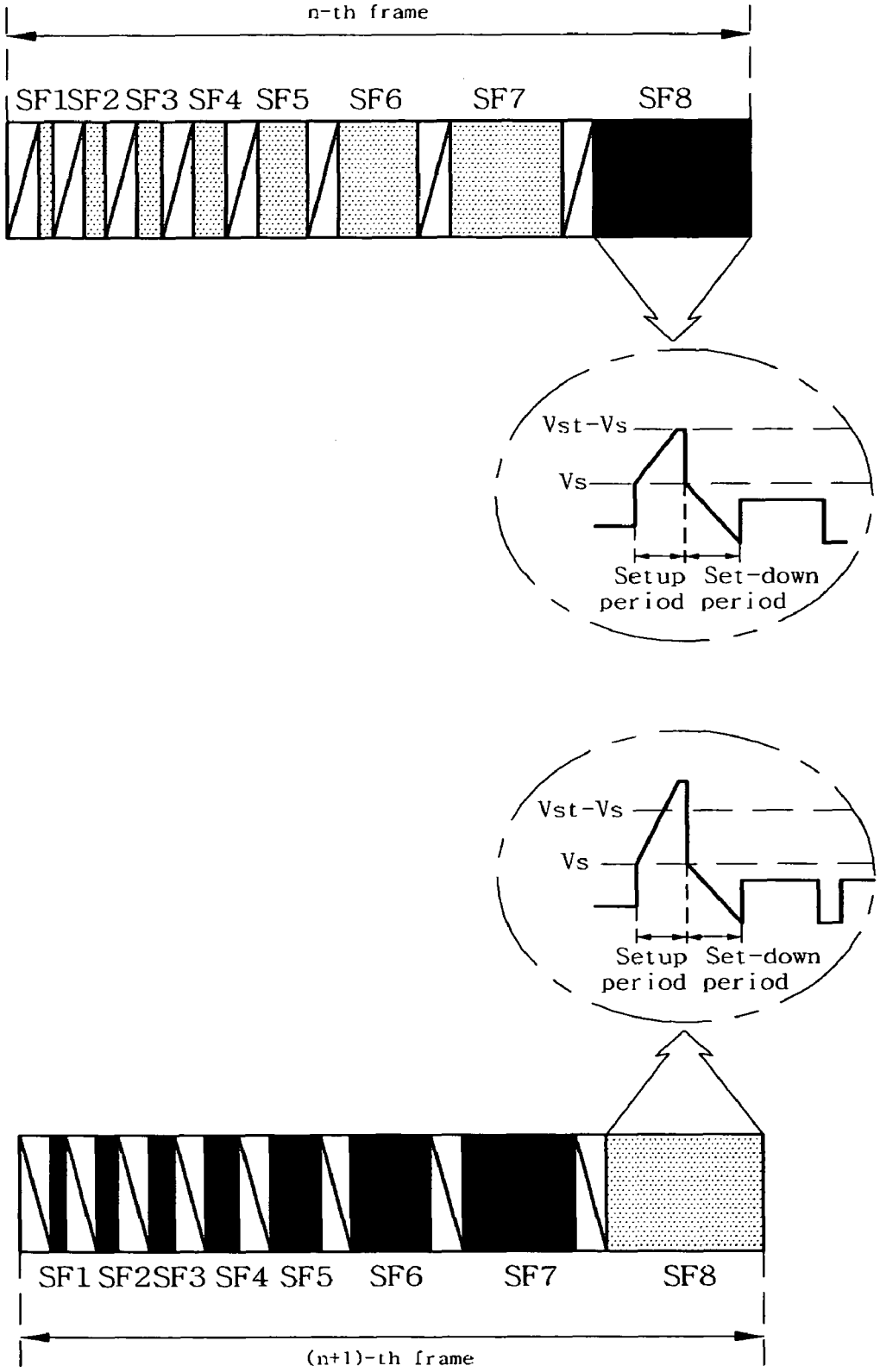
FIG. 11 illustrates a method of driving a plasma display apparatus according to a sixth embodiment.

FIG. 11 illustrates a method of driving a plasma display apparatus according to a sixth embodiment.

As illustrated in FIG. 11, the number of sustain signals assigned in subfields SF1 to SF7 of an n-th frame is less than the number of sustain signals assigned in a subfield SF8 of an (n+1)-th frame. Further, at least one of the highest voltage or a rising slope of the reset signal supplied during a subfield SF8 of the n-th frame is less than at least one of the highest voltage or a rising slope of the reset signal supplied during the subfield SF8 of the (n+1)-th frame.

To prevent gray level inversion, quantity of light emitted during the subfield SF8 of the (n+1)-th frame has to increase. When the highest voltage or the rising slope of the reset signal supplied during the subfield SF8 of the (n+1)-th frame, as illustrated in FIG. 11, increases, the quantity of light emitted during the subfield SF8 of the (n+1)-th frame increases by an increase in the number of reset discharge times. Thus, the gray level inversion is prevented.

The number of sustain signals as well as the highest voltage or the rising slope of the reset signal may increase. More specifically, the number of sustain signals assigned in the subfields SF1 to SF7 of the n-th frame is less than the number of sustain signals assigned in the subfield SF8 of the (n+1)-th frame, and the number of sustain signals assigned in the subfield SF8 of the n-th frame is less than the number of sustain signals assigned in the subfield SF8 of the (n+1)-th frame. At the same time, at least one of the highest voltage or the rising slope of the reset signal supplied during the subfield SF8 of the n-th frame is less than at least one of the highest voltage or the rising slope of the reset signal supplied during the subfield SF8 of the (n+1)-th frame.

Accordingly, a strong sustain discharge occurs in the subfield SF8 of the (n+1)-th frame, and thus preventing the gray level inversion.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A method of driving a plasma display apparatus comprising supplying a data signal to a discharge cell during a-th to b-th subfields, arranged in increasing order of gray level weight, of an n-th frame, and supplying a data signal to the discharge cell during a (b+1)-th subfield of an (n+1)-th frame, wherein:

a number of sustain signals assigned in the a-th to b-th subfields of the n-th frame is less than a number of sustain signals assigned in the (b+1)-th subfield of the (n+1)-th frame, a number of sustain signals assigned in a (b+1)-th subfield of the n-th frame is less than a number of sustain signals assigned in the (b+1)-th subfield of the (n+1)-th frame widths of all the sustain signals supplied to a scan electrode and a sustain electrode during the (b+1)-th subfield of the (n+1)-th frame are greater than widths of all the sustain signals supplied to the scan electrode and the sustain electrode during the (b+1)-th subfield of the n-th frame.

2. A plasma display apparatus, comprising:

a plasma display panel including a scan electrode, an address electrode, and a sustain electrode;

a data driver to supply a data signal to the address electrode during a-th to b-th subfields, arranged in increasing order of gray level weight, of an n-th frame, and to supply a data signal to the address electrode during a (b+1)-th subfield of an (n+1)-th frame; and a scan driver and a sustain driver to supply a number of sustain signals to the scan electrode and the sustain electrode respectively, that is more than a number of sustain signals assigned in a (b+1)-th subfield of the n-th frame, to the scan electrode and the sustain electrode during the (b+1)-th subfield of the (n+1)-th frame, respectively, wherein:

a number of sustain signals assigned in the a-th to b-th subfields of the n-th frame is less than a number of sustain signals assigned in the (b+1)-th subfield of the (n+1)-th frame, and widths of all the sustain signals supplied to the scan electrode and the sustain electrode during the (b+1)-th subfield of the (n+1)-th frame are greater than widths of all the sustain signals supplied to the scan electrode and the sustain electrode during the (b+1)-th subfield of the n-th frame.

* * * * *